US010307767B2

(12) United States Patent
Nishizawa

(10) Patent No.: US 10,307,767 B2
(45) Date of Patent: Jun. 4, 2019

(54) ROTARY DRUM-TYPE MAGNETIC SEPARATOR

(71) Applicant: SUMITOMO HEAVY INDUSTRIES FINETECH, LTD., Okayama (JP)

(72) Inventor: Shinya Nishizawa, Okayama (JP)

(73) Assignee: SUMITOMO HEAVY INDUSTRIES FINETECH, LTD., Okayama (JP)

( * ) Notice: Subject to any disclaimer, the term of this patent is extended or adjusted under 35 U.S.C. 154(b) by 0 days.

(21) Appl. No.: 15/476,606

(22) Filed: Mar. 31, 2017

(65) Prior Publication Data

US 2017/0203303 A1 Jul. 20, 2017

Related U.S. Application Data

(63) Continuation of application No. PCT/JP2015/075807, filed on Sep. 11, 2015.

(30) Foreign Application Priority Data

Oct. 1, 2014 (JP) ..... 2014-202824

(51) Int. Cl.
*B03C 1/12* (2006.01)
*B03C 1/14* (2006.01)
*B03C 1/033* (2006.01)

(52) U.S. Cl.
CPC ..... *B03C 1/12* (2013.01); *B03C 1/0332* (2013.01); *B03C 1/14* (2013.01); *B03C 2201/18* (2013.01)

(58) Field of Classification Search
None
See application file for complete search history.

(56) References Cited

U.S. PATENT DOCUMENTS

| | | | |
|---|---|---|---|
| 2,559,565 | A | 7/1951 | Crockett et al. |
| 2,901,108 | A | 8/1959 | Spodig |
| 2,952,361 | A | 9/1960 | Newton |

FOREIGN PATENT DOCUMENTS

| | | | |
|---|---|---|---|
| CN | 101391457 | A | 3/2009 |
| JP | S52-050507 | A | 4/1977 |
| JP | S63-046125 | Y2 | 12/1988 |
| JP | H09-024205 | A | 1/1997 |
| JP | 3050340 | U | 7/1998 |

(Continued)

OTHER PUBLICATIONS

The Translation of the Written Opinion for PCT/JP2015/075807, dacted Apr. 2015.*

(Continued)

*Primary Examiner* — David A Reifsnyder
(74) *Attorney, Agent, or Firm* — Michael Best & Friedrich LLP

(57) ABSTRACT

A rotary drum-type magnetic separator includes a first rotary drum on which a plurality of magnets are disposed and separates unnecessary objects from a used coolant liquid. A second rotary drum on which a plurality of magnets are disposed is provided before the first rotary drum in a direction in which the used coolant liquid flows separately from the first rotary drum. The second rotary drum includes an outer tube and an inner tube. A scraper which scrapes off the unnecessary objects attached to the second rotary drum is connected to a bottom member which forms a flow path below the first rotary drum.

20 Claims, 7 Drawing Sheets

(56) References Cited

FOREIGN PATENT DOCUMENTS

| | | | |
|---|---|---|---|
| JP | 3057175 | U | 3/1999 |
| JP | 2003-038907 | A | 2/2003 |
| JP | 2007-000978 | A | 1/2007 |
| JP | 2009-172589 | A | 8/2009 |
| JP | 2009-172590 | A | 8/2009 |
| JP | 2011-025391 | A | 2/2011 |
| JP | 2014-126140 | A | 7/2014 |
| JP | 2014-151314 | A | 8/2014 |

OTHER PUBLICATIONS

International Search Report issued in Application No. PCT/JP2015/075807, dated Nov. 24, 2015.
Supplementary Search Report issued in European Patent Application No. 15846897.5, dated Apr. 23, 2018.

* cited by examiner

ROTARY DRUM-TYPE MAGNETIC SEPARATOR

RELATED APPLICATIONS

Priority is claimed to Japanese Patent Application No. 2014-202824, filed Oct. 1, 2014, and International Patent Application No. PCT/JP2015/075807, the entire content of each of which is incorporated herein by reference.

BACKGROUND

Technical Field

Certain embodiment of the present invention relates to a rotary drum-type magnetic separator which recovers a metal component from sludge included in a coolant liquid.

Description of Related Art

In polishing, cutting, or the like of a metal material, particularly, a magnetic material represented by a steel material, sludge-shaped cut chips, chips, or the like discharged along with a coolant liquid are separated from a liquid to be recovered. Since the cut chips, the chips, or the like have various shapes, various magnetic separation (recovery) devices are developed from the viewpoint of recovery efficiency.

For example, since the chips are powdery, the chips are easily collected and are likely to contain a liquid. Accordingly, a magnetic separation device which favorably separates the liquid of the sludge is required. For example, FIG. 1 is a sectional view taken along a surface orthogonal to a rotary shaft of a rotary drum showing a configuration of a rotary drum-type magnetic separator of the related art.

As shown in FIG. 1, in the rotary drum-type magnetic separator of the related art, a liquid reservoir portion 2 which stores a coolant liquid is provided inside a box-shaped main body 1. In addition, a rotary drum 3 is pivotally supported in an approximately horizontal direction in the vicinity of a center portion of the main body 1 so as to divide the liquid reservoir portion 2 into two. The rotary drum 3 is a cylindrical body formed of a nonmagnetic material such as stainless steel, and inner tube 5 in which a plurality of magnets 4, 4, . . . are disposed in a predetermined arrangement on the outer peripheral surface is coaxially fixed to the inner portion of an outer tube 9. In the plurality of magnets 4, 4, . . . , in order to magnetically attach cut chips, chips, or the like included in the coolant liquid, magnetic poles are disposed to generate a predetermined magnetic flux on the outer peripheral surface of the rotary drum 3.

In the example of FIG. 1, the plurality of magnets 4, 4, . . . are disposed from a portion in which the rotary drum 3 is immersed into the liquid reservoir portion 2 to a top portion, that is, on the inner tube 5 corresponding to a portion equivalent to approximately ¾ of the outer periphery of the rotary drum 3. In a portion corresponding to the approximately remaining ¼, the magnets 4, 4, . . . are not disposed on the inner tube 5 and a magnetic force does not act on the portion.

The cut chips, the chips, or the like, which are magnetically attached to the outer peripheral surface of the outer tube 9 on the bottom portion of liquid reservoir portion 2 by the magnetic forces of the magnets 4, 4, . . . , are transported to the top portion of the rotary drum 3 according to the rotation of the outer tube 9, magnetization forces generated by the magnetic forces of the magnets 4, 4, . . . are released at the time point at which the cut chips, the chips, or the like pass through the top portion, and the cut chips, the chips, or the like are scrapped off by a scraper 7 abutting on the rotary drum 3 so as to be recovered. A squeezing roller 6 in which an elastic body such as rubber is disposed on the surface is provided in the vicinity of the top portion of the rotary drum 3 and abuts on the outer peripheral surface of the outer tube 9 of the rotary drum 3 by predetermined pressing. The magnetically attached sludge passes through a portion between the outer tube 9 and the squeezing roller 6, a liquid of the sludge is squeezed out, and the cut chips, the chips, or the like are separated and recovered at the time point at which the sludge passes through the top portion of the rotary drum 3, that is, a position at which the magnetic force of the magnet 4 is not applied.

In the above-described rotary drum-type magnetic separator of the related art, it is possible to purify the coolant liquid up to a certain level. However, recently, it is required to perform purification to be the coolant liquid having high cleanness. Meanwhile, for example, in the related art, a plurality of magnetic separation devices are disposed in multiple stages so as to provide a coolant liquid having higher cleanness.

Moreover, in the related art, a purifying device is disclosed, which includes a first rotary drum in which a plurality of magnets are disposed on the outer peripheral surface, and a second rotary drum which is disposed so as to be close to the first rotary drum and in which a plurality of magnets are disposed on an outer peripheral surface to which suspended solid matters adsorbed to the first rotary drum and transported therefrom are delivered.

SUMMARY

According to an embodiment of the present invention, there is provided a rotary drum-type magnetic separator which separates magnetic substances from a used coolant liquid, including: a first rotary drum on which a plurality of magnets are disposed; a second rotary drum on which a plurality of magnets are disposed and which is provided before the first rotary drum in a direction in which the used coolant liquid flows such that the magnetic substances are adsorbed to each other so as to be getting larger by magnetizing the magnetic substances in the used coolant liquid using the second drum; a scraper which scrapes off the magnetic substances attached to the second rotary drum; and a bottom member which forms a flow path below the first rotary drum, in which the magnetic substances are introduced to the first rotary drum along a flow of the used coolant liquid in a state where sizes of the magnetic substances scrapped off by the scraper are increased.

DETAILED DESCRIPTION

Figure 1:
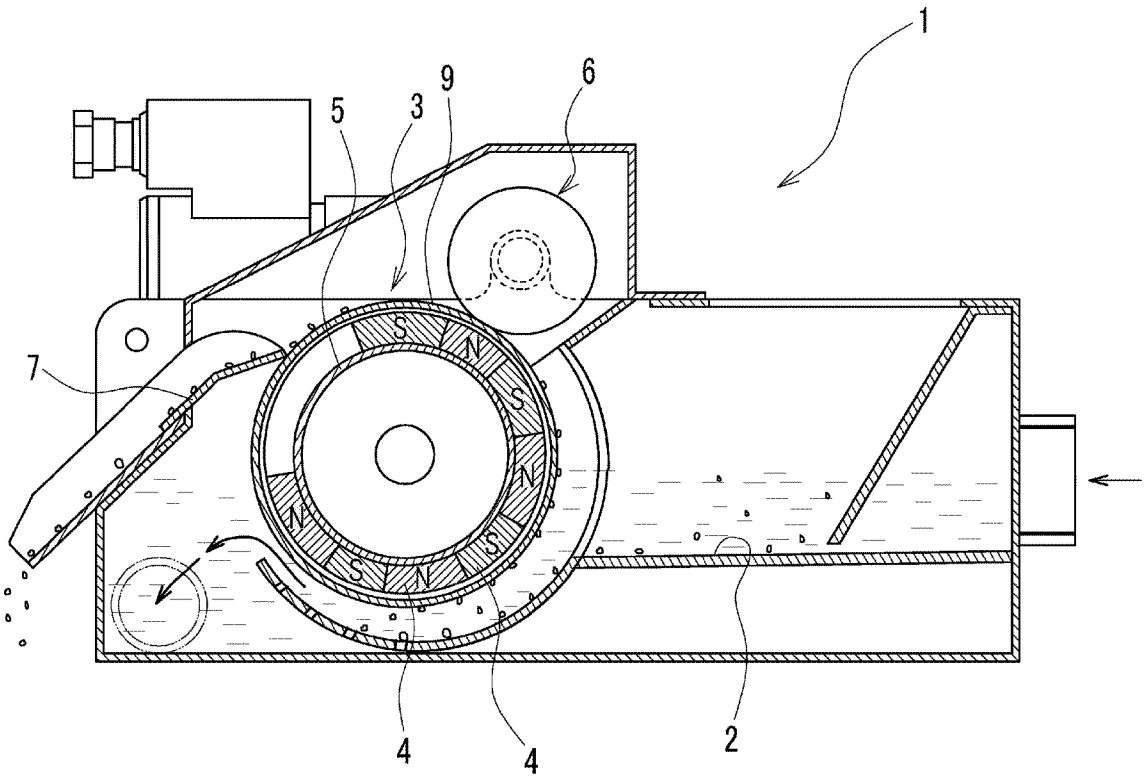
FIG. 1 RELATED ART
FIG. 1 is a sectional view taken along a surface orthogonal to a rotary shaft of a rotary drum showing a configuration of a rotary drum-type magnetic separator of the related art.

However, as disclosed in the related art, in the method of disposing the magnetic separation devices in multiple stages, it is necessary to provide a plurality of magnetic separation devices, which is not a realistic solution from the viewpoint of a manufacturing cost.

Moreover, in the related art, sizes of suspended solid matters which are finally recovered can be classified by magnitudes of magnetic forces of magnets mounted on a second rotary drum. However, since the sizes of suspended solid matters which are recovered from a coolant liquid are the same as those in the past, the total amount of the suspended solid matters in the circulating coolant liquid is not changed, and there is a problem that it is not possible to improve cleanness of the coolant liquid.

It is desirable to provide a rotary drum-type magnetic separator in which cleanness of a circulating coolant liquid can be improved by a simple structure.

In a rotary drum-type magnetic separator according to an embodiment of the present invention, the separator includes a second rotary drum on which a plurality of magnets are disposed and which is provided before a first rotary drum in a direction in which a used coolant liquid flows such that magnetic substances are adsorbed to each other so as to be getting larger by magnetizing the magnetic substances in the used coolant liquid using the second drum, the scraper which scrapes off the magnetic substances attached to the second rotary drum, and a bottom member which forms a flow path below the first rotary drum, in which the magnetic substances are introduced to the first rotary drum along a flow of the used coolant liquid in a state where the sizes of the magnetic substances scrapped off by the scraper are increased. Accordingly, magnetic substances adsorbed by the second rotary drum are attracted to each other by being magnetized, fine particles are collected, and the size per grain increases. Therefore, since the magnetic substances are introduced to the first rotary drum in which the state where the magnetic substances are particles of which the sizes are increased, it is possible to more reliably recover the magnetic substances by the first rotary drum, and it is possible to further improve cleanness of the coolant liquid.

In addition, in the rotary drum-type magnetic separator, the second rotary drum may include an outer tube and an inner tube, and the outer tube may be fixed and the inner tube on which a plurality of magnets are disposed may rotate inside the outer tube.

In this configuration, since the second rotary drum includes the outer tube and the inner tube, and the outer tube is fixed and the inner tube on which the plurality of magnets are disposed can rotate inside the outer tube, it is possible to more reliably recover the magnetic substances by the first rotary drum, and it is possible to further improve cleanness of the coolant liquid.

Moreover, in the rotary drum-type magnetic separator, the second rotary drum may include an outer tube and an inner tube, and the inner tube on which a plurality of magnets are disposed may be fixed and the outer tube may rotate outside the inner tube.

In this configuration, since the second rotary drum includes the outer tube and the inner tube, and the inner tube on which the plurality of magnets are disposed is fixed and the outer tube can rotate outside the inner tube, it is possible to more reliably recover the magnetic substances by the first rotary drum, and it is possible to further improve cleanness of the coolant liquid.

Moreover, in the rotary drum-type magnetic separator, the second rotary drum may include an outer tube and an inner tube, and the inner tube on which a plurality of magnets are disposed and the outer tube may rotate with respect to each other.

In this configuration, since the second rotary drum includes the outer tube and the inner tube, and the inner tube on which the plurality of magnets are disposed and the outer tube can rotate with respect to each other, it is possible to more reliably recover the magnetic substances by the first rotary drum, and it is possible to further improve cleanness of the coolant liquid.

Moreover, in the rotary drum-type magnetic separator, the scraper may be inclined to descend toward the first rotary drum side from the second rotary drum side.

In this configuration, since the scraper is inclined to descend toward the first rotary drum side from the second rotary drum side, magnetic substances which are attracted (are adsorbed) to each other on the peripheral surface of the second rotary drum and in which the sizes increases are easily separated from the second rotary drum, and it is possible to reliably introduce magnetic substances to the first rotary drum in the state where the sizes are increased.

In addition, in the rotary drum-type magnetic separator, the second rotary drum may include a strong magnetic portion which has a stronger magnetic force than those of the surroundings and a weak magnetic portion which has a weaker magnetic force than those of the surroundings.

In this configuration, since the second rotary drum includes the strong magnetic portion which has a stronger magnetic force than those of the surroundings and the weak magnetic portion which has a weaker magnetic force than those of the surroundings, the magnetic substances magnetically attached by the strong magnetic portion can be separated by the weak magnetic portion, and it is possible to more reliably introduce the magnetic substances in which the sizes per grain are increased to the first rotary drum.

Moreover, in the rotary drum-type magnetic separator, a plurality of sets of magnets in which two magnets having polarities different from each other are formed as one set may be mounted on the inner tube of the second rotary drum.

In this configuration, since a plurality of sets of magnets in which two magnets having polarities different from each other are formed as one set are mounted on the inner tube of the second rotary drum, it is possible to form a stronger magnetic portion or a weaker magnetic portion by devising the disposition of the magnets such as disposing two sets of adjacent magnets such that the polarities are opposite to each other, and it is possible to more reliably introduce the magnetic substances in which the sizes per grain are increased to the first rotary drum.

In addition, in the rotary drum-type magnetic separator, in one set of magnets mounted on the inner tube of the second rotary drum, a thickness of one magnet may be thicker than a thickness of the other magnet.

In this configuration, since in one set of magnets mounted on the inner tube of the second rotary drum, the thickness of one magnet is thicker than the thickness of the other magnet, it is possible to form a stronger magnetic portion or a weaker magnetic portion, and it is possible to more reliably introduce the magnetic substances in which the sizes per grain are increased to the first rotary drum.

Moreover, in the rotary drum-type magnetic separator, in a case where even magnet sets are mounted on the inner tube of the second rotary drum, polarities of one set of magnets adjacent to each other may be opposite to each other.

In this configuration, in the case where even magnet sets are mounted on the inner tube of the second rotary drum, since polarities of one set of magnets adjacent to each other are opposite to each other, it is possible to reliably form the weak magnetic portion in which the magnetic force is relatively weak between the magnets of each set, and it is possible to more reliably introduce the magnetic substances in which the sizes per grain are increased to the first rotary drum.

According to an embodiment of the present invention, magnetic substances adsorbed by the second rotary drum are attracted to each other by being magnetized, fine particles are collected, and the size per grain increases. Therefore, since the magnetic substances are introduced to the first rotary drum in the state where the magnetic substances become large particles, it is possible to more reliably recover the magnetic substances is by the first rotary drum, and it is possible to further improve cleanness of the coolant liquid.

Figure 2:
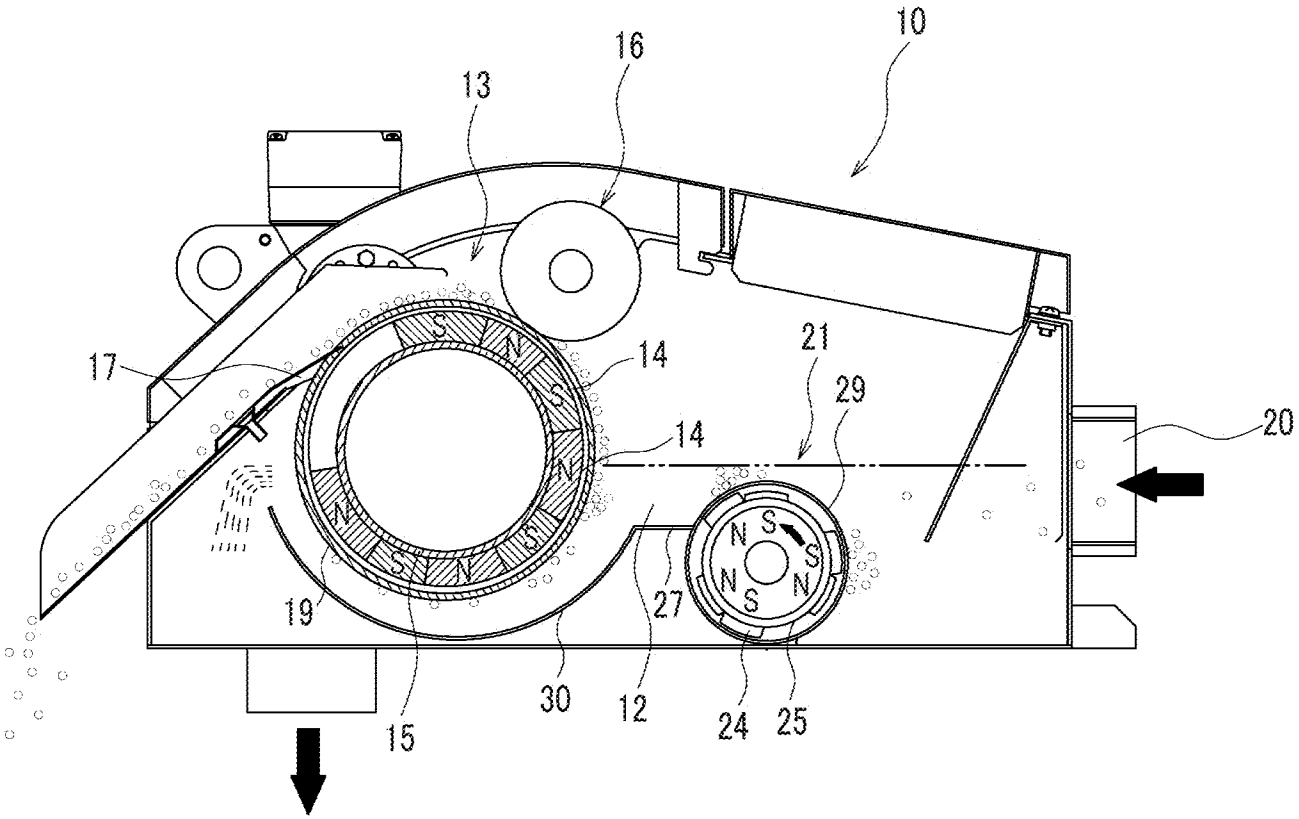
FIG. 2 is a sectional view taken along a surface orthogonal to a rotary shaft of a rotary drum showing a configuration of a rotary drum-type magnetic separator according to an embodiment of the present invention.

Hereinafter, the present invention will be described in detail based on the drawings showing the embodiment. FIG. 2 is a sectional view taken along a surface orthogonal to a rotary shaft of a rotary drum showing a configuration of a rotary drum-type magnetic separator according to an embodiment of the present invention.

As shown in FIG. 2, in the rotary drum-type magnetic separator according to the present embodiment, a liquid reservoir portion 12 which stores a coolant liquid is provided inside a box-shaped main body 10, and a used coolant liquid in which sludge including cut chips, chips, or the like after polishing or cutting is mixed is charged into the liquid reservoir portion 12 from a charge port 20.

In order to divide the liquid reservoir portion 12 into two, a first rotary drum 13 is pivotally supported in the vicinity of a center portion of the main body 10 so as to be rotatable in an approximately horizontal direction. The first rotary drum 13 is a cylindrical body formed of a nonmagnetic material such as stainless steel, and inner tube 15 in which a plurality of magnets 14, 14, . . . are disposed in a predetermined arrangement on the outer peripheral surface is fixed to the inner portion of an outer tube 19 so as to be coaxial to the outer tube 19. In the plurality of magnets 14, 14, . . . , in order to magnetically attach cut chips, chips, or the like which are magnetic substances included in the used coolant liquid, polarities are disposed to generate a predetermined magnetic flux on the outer peripheral surface of the outer tube 19. In addition, as shown in FIG. 2, adjacent magnets 14 and 14 are disposed such that the polarities are opposite to each other, and specifically, the magnets 14 are alternately disposed on the outer peripheral surface of the inner tube 15 such that the outer peripheral surface is the magnet of "N" pole, the outer peripheral surface is the magnet of "S" pole, . . . .

In FIG. 2, the plurality of magnets 14, 14, . . . are disposed from a portion in which the first rotary drum 13 is immersed into the liquid reservoir portion 12 to a top portion, that is, on the inner tube 15 corresponding to a portion equivalent to approximately ¾ of the outer periphery of the first rotary drum 13. In a portion corresponding to the approximately remaining ¼, the magnets 14, 14, . . . are not disposed on the inner tube 15 and a magnetic force does not act on the portion.

The cut chips, the chips, or the like, which are the magnetic substances and magnetically attached to the outer peripheral surface of the outer tube 19 of the first rotary drum 13 on the bottom portion of liquid reservoir portion 12 by the magnetic forces of the plurality of magnets 14, 14, . . . , are transported to the top portion of the first rotary drum 13 according to the rotation of the outer tube 19, the cut chips, the chips, or the like are released from magnetization forces generated by the plurality of magnets 14, 14, . . . at the time point at which the cut chips, the chips, or the like pass through the top portion, and the cut chips, the chips, or the like are scrapped off by a scraper 17 abutting on the outer tube 19 so as to be recovered. A squeezing roller 16 in which an elastic body such as rubber is disposed on the surface is provided in the vicinity of the top portion of the first rotary drum 13 and abuts on the outer peripheral surface of the outer tube 19 of the first rotary drum 13 by predetermined pressing. The magnetically attached sludge including the cut chips, chips, or the like passes through a portion between the outer tube 19 and the squeezing roller 16, a liquid of the sludge is squeezed out, and the cut chips, the chips, or the like are separated and recovered at the time point at which the sludge passes through the top portion of the first rotary drum 13, that is, a position at which the magnetic force of the magnet 14 is not applied.

As an elastic body which is used in an abutment surface of the squeezing roller 16 with respect to the outer peripheral surface of the first rotary drum 13, an elastic body such as CR (chloroprene) based rubber or NBR (nitrile) based rubber is mainly used. However, for example, an uncross-linked polyurethane material containing polyester polyol as a main component may be used.

In the present embodiment, in addition to the first rotary drum 13, a second rotary drum 21 having a smaller diameter than that of the first rotary drum 13 is disposed before the first rotary drum 13 in a direction in which the used coolant liquid flows. That is, first, after the cut chips or the chips which are magnetic substances are adsorbed by the second rotary drum 21, and the cut chips, the chips collected by the first rotary drum 13 are adsorbed again.

Similarly to the first rotary drum 13, the second rotary drum 21, the second rotary drum 21 is a cylindrical body formed of a nonmagnetic material such as stainless steel, and inner tube 25 in which a plurality of magnets 24, 24, . . . are disposed in a predetermined arrangement on the outer peripheral surface is fixed to the inner portion of an outer tube 29 so as to be rotatable coaxially with the outer tube 29. In the plurality of magnets 24, 24, . . . , in order to magnetically attach cut chips, chips, or the like which are magnetic substances included in the used coolant liquid, polarities are disposed to generate a predetermined magnetic flux on the outer peripheral surface of the outer tube 29. In addition, each of "N" and "S" shown in FIG. 2 indicates a polarity of the surface side opposite to the outer peripheral surface side of the outer tube 29 of the magnet 24.

In FIG. 2, the entire second rotary drum 21 is immersed into the liquid reservoir portion 12. In addition, the plurality of magnets 24, 24, . . . are disposed on the inner tube 25. The cut chips, the chips, or the like, which are magnetic substances magnetically attached to the outer peripheral surface of the outer tube 29 of the second rotary drum 21 on the bottom portion of liquid reservoir portion 12 by the magnetic forces of the plurality of magnets 24, 24, . . . , move on the outer peripheral surface of the outer tube 29 according to the rotation of the inner tube 25, pass through the top portion of the second rotary drum 21, and are scrapped off by a scraper 27 abutting on the outer tube 29. The scraper 27 is connected to a bottom member 30 which forms a flow path below the first rotary drum 13 and introduces scraped unnecessary objects (magnetic substances) to the first rotary drum 13.

Figure 3:
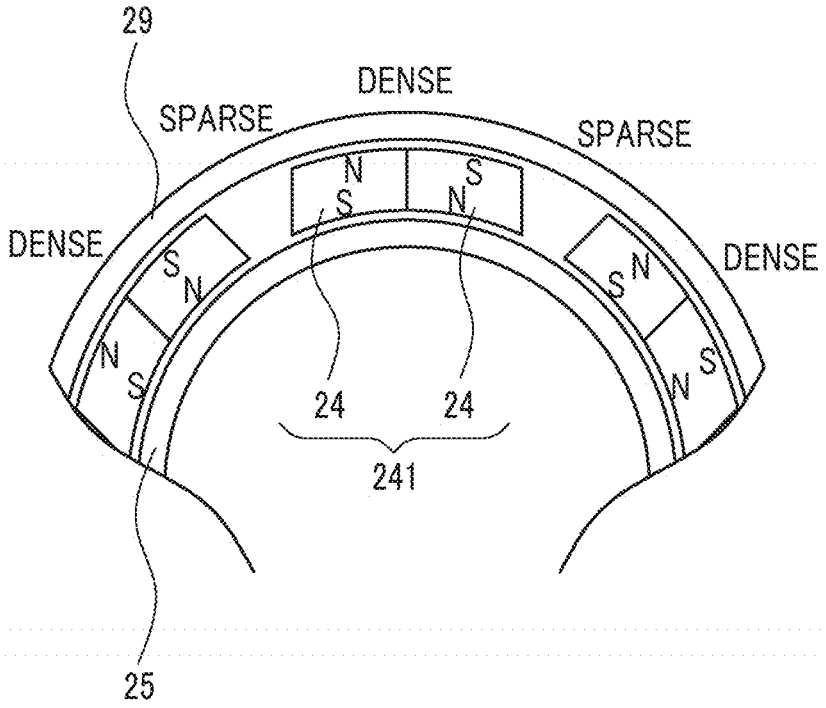
FIG. 3 is an exemplary view showing a distribution of a magnetic flux density of a second rotary drum of the rotary drum-type magnetic separator according to the embodiment of the present invention.

Here, the plurality of magnets 24, 24, . . . are disposed such that the magnetic poles alternate with each other and a magnetic flux emitted from the outer peripheral surface of the outer tube 29 is discontinuous. FIG. 3 is an exemplary view showing a distribution of a magnetic flux density of the second rotary drum 21 of the rotary drum-type magnetic separator according to the embodiment of the present invention. In FIG. 3, "sparse" and "dense" respectively indicate a portion having a large magnetic flux density and a portion having a small magnetic flux density.

As shown in FIG. 3, in the plurality of magnets 24, 24, . . . , a magnet group 241 in which two magnets 24 and 24 are formed as one set is disposed on the outer peripheral surface of the inner tube 25, and magnetic poles on the outer peripheral surface side are disposed to alternate with each other such as a case where the N pole, the S pole, the N pole, the S pole, . . . are sequentially arranged. According to this disposition, in the front surface of the magnet group 241 and a gap portion between the magnet groups 241 and 241, there is a difference in magnetic flux densities of magnetic fluxes emitted from the outer peripheral surface of the outer tube 29. For example, a strong magnetic portion in which the magnetic flux density is large, that is, the magnetic force is strong, and a weak magnetic portion in which the magnetic flux density is small, that is, the magnetic force is weak are generated.

Moreover, in the strong magnetic portion, cut chips, chips, or the like magnetized on the surface of the outer tube 29 are easily adsorbed, and even when the chips, chips, or the like are fine particles, these are attracted to each other so as be easily increased. Meanwhile, in the weak magnetic portions, the chips, chips, or the like are easily separated from the surface of the outer tube 29. Accordingly, at the time point at which the weak magnetic portion reaches the scraper 27 according to the rotation of the inner tube 25, unnecessary objects (magnetic substances) such as relatively large cut chips or chips are easily separated and are introduced to the first rotary drum 13 along the flow of the used coolant liquid in a state in which the size per grain is increased.

Figure 4B:
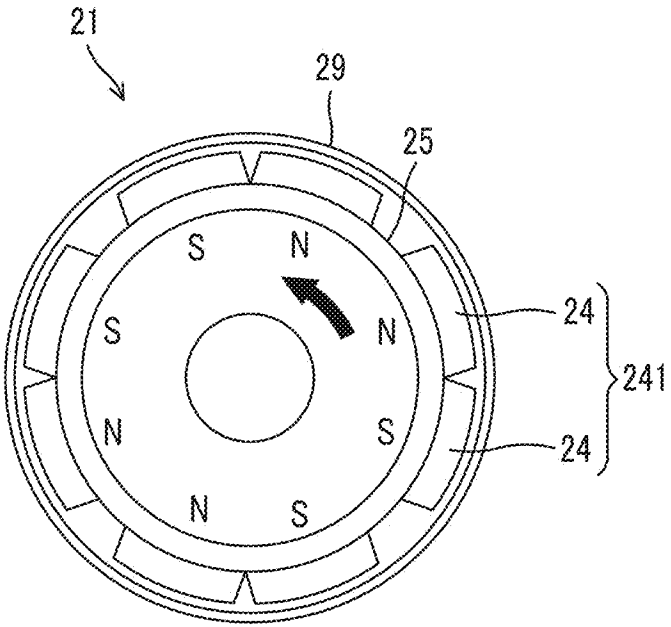
FIGS. 4A and 4B are schematic sectional views taken along a surface orthogonal to a rotary shaft of the second rotary drum showing a disposition example of a plurality of magnets of the second rotary drum according to the embodiment of the present invention.
Figure 4A:
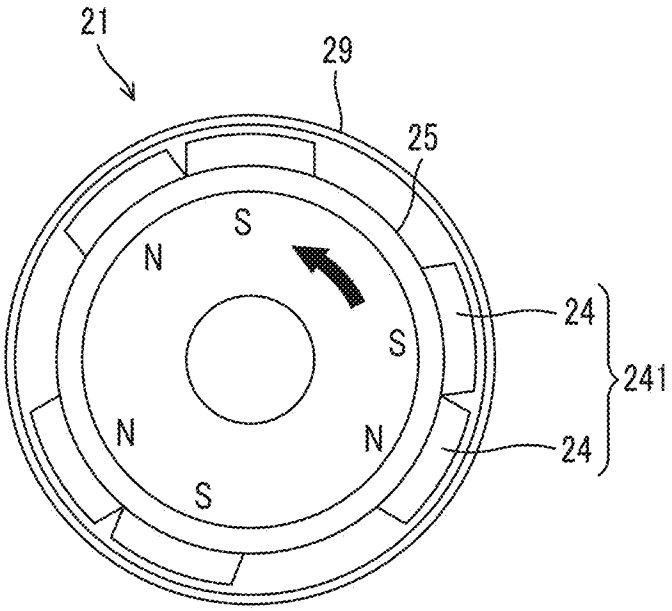

The disposition of the plurality of magnets 24, 24, . . . in the second rotary drum 21 of the rotary drum-type magnetic separator according to the present embodiment is not particularly limited to this. FIGS. 4A and 4B are schematic sectional views taken along a surface orthogonal to a rotary shaft of the second rotary drum 21 showing a disposition example of the plurality of magnets 24, 24, . . . of the second rotary drum 21 according to the embodiment of the present invention.

In the example of FIG. 4A, three magnet groups 241 in which two magnets 24 and 24 are formed as one set are disposed, and in the example of FIG. 4B, four magnet groups 241 are disposed. In a case where odd magnet groups 241 are disposed as shown in FIG. 4A, since the weak magnetic portion is formed between the adjacent magnet groups 241 and 241, even when polarities of the adjacent magnet groups 241 are disposed to be opposite to each other, a portion in which the magnets 24 and 24 having polarities different from each other face each other is generated.

Meanwhile, in a case where even magnet groups 241 are disposed as shown in FIG. 4B, since the weak magnetic portion is formed between the adjacent magnet groups 241 and 241, even when polarities of the adjacent magnet groups 241 are disposed to be opposite to each other, a portion in which the magnets 24 and 24 having polarities different from each other face each other is not generated. That is, since the strong magnetic portions and the weak magnetic portions are generated at equal intervals on the peripheral surface of the second rotary drum 21, it is possible to introduce the unnecessary object (magnetic substance) having a constant size to the first rotary drum 13.

Moreover, in one magnet group 241 which is mounted on the inner tube 25 of the second rotary drum 21, the thickness of one magnet 24 may be thicker than the thickness of the other magnet 24. Accordingly, the magnetic flux density is proportional to the thickness of the magnet 24, and in the magnet group 241, the strong magnetic portion and the weak magnetic portion are generated.

Figure 5B:
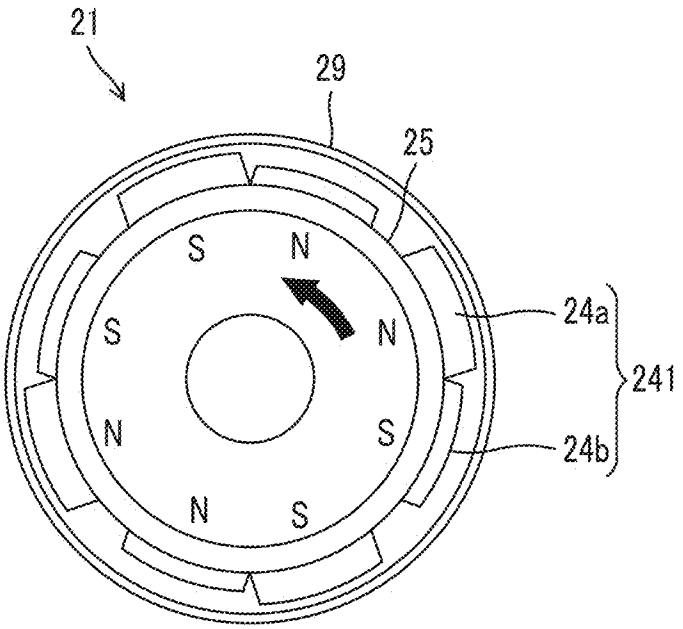
FIGS. 5A and 5B are schematic sectional views taken along a surface orthogonal to the rotary shaft of the second rotary drum showing another disposition example of the plurality of magnets of the second rotary drum according to the embodiment of the present invention.
Figure 5A:
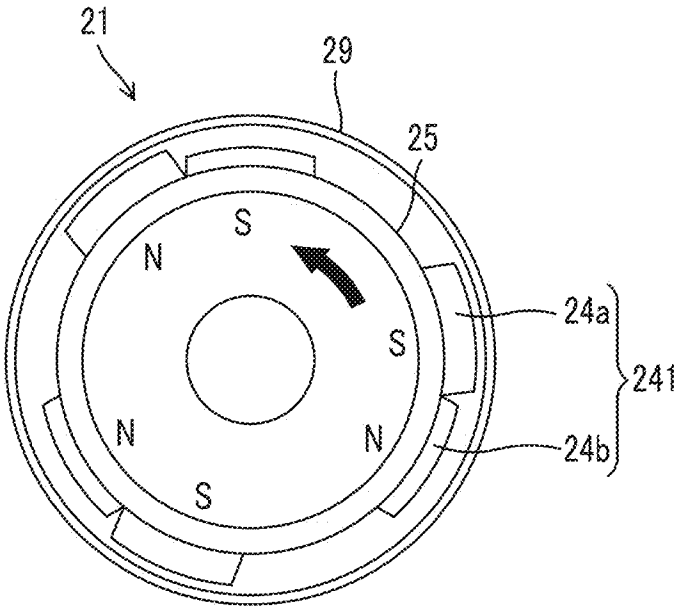

FIGS. 5A and 5B are schematic sectional views taken along a surface orthogonal to the rotary shaft of the second rotary drum 21 showing another disposition example of a plurality of magnets 24*a*, 24*b*, . . . of the second rotary drum 21 according to the embodiment of the present invention. In the example of FIG. 5A, three magnet groups 241 in which two magnets 24*a* and 24*b* are formed as one set are disposed, and in the example of FIG. 5B, four magnet groups 241 are disposed.

As shown in FIGS. 5A and 5B, in the present embodiment, in two magnets 24*a* and 24*b* for each magnet group 241, the thickness of one magnet 24*a* which reaches the scraper 27 earlier in the rotation direction of the second rotary drum is thicker than the thickness of the adjacent other magnet 24*b*. Accordingly, since the strong magnetic portion and the weak magnetic portion are generated in the magnet group 241, unnecessary objects (magnetic substances) are more reliably attracted to each other, and it is possible to introduce the unnecessary objects (magnetic substances) in which the sizes per grain are increased to the first rotary drum 13.

Figure 6:
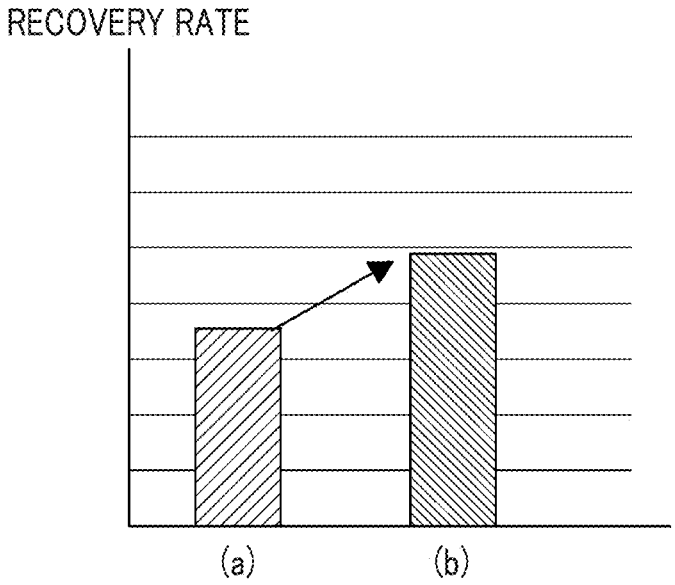
FIG. 6 is a graph showing variation in recovery rates of magnetic sludge which is an unnecessary object.

FIG. 6 is a graph showing variation in recovery rates of magnetic sludge which is the unnecessary object. In FIG. 6, (a) shows the recovery rate of the unnecessary object such as the magnetic sludge in the rotary drum-type magnetic separator of the related art.

Meanwhile, (b) shows the recovery rate of the unnecessary object such as the magnetic sludge in a case where the second rotary drum 21 is provided in the rotary drum-type magnetic separator of the related art. As can be seen by comparing (a) and (b) in FIG. 6, it is obvious that the recovery rate of (b) is higher than that of (a).

Here, the scraper 27 is not limited to the case shown in FIG. 2 of being provided in the horizontal direction. For example, since it is enough for the scraper 27 to be connected to the bottom member forming the flow path below the first rotary drum 13, the scraper 27 may be inclined so as to descend toward the first rotary drum 13 from the second rotary drum 21 side.

Figure 7:
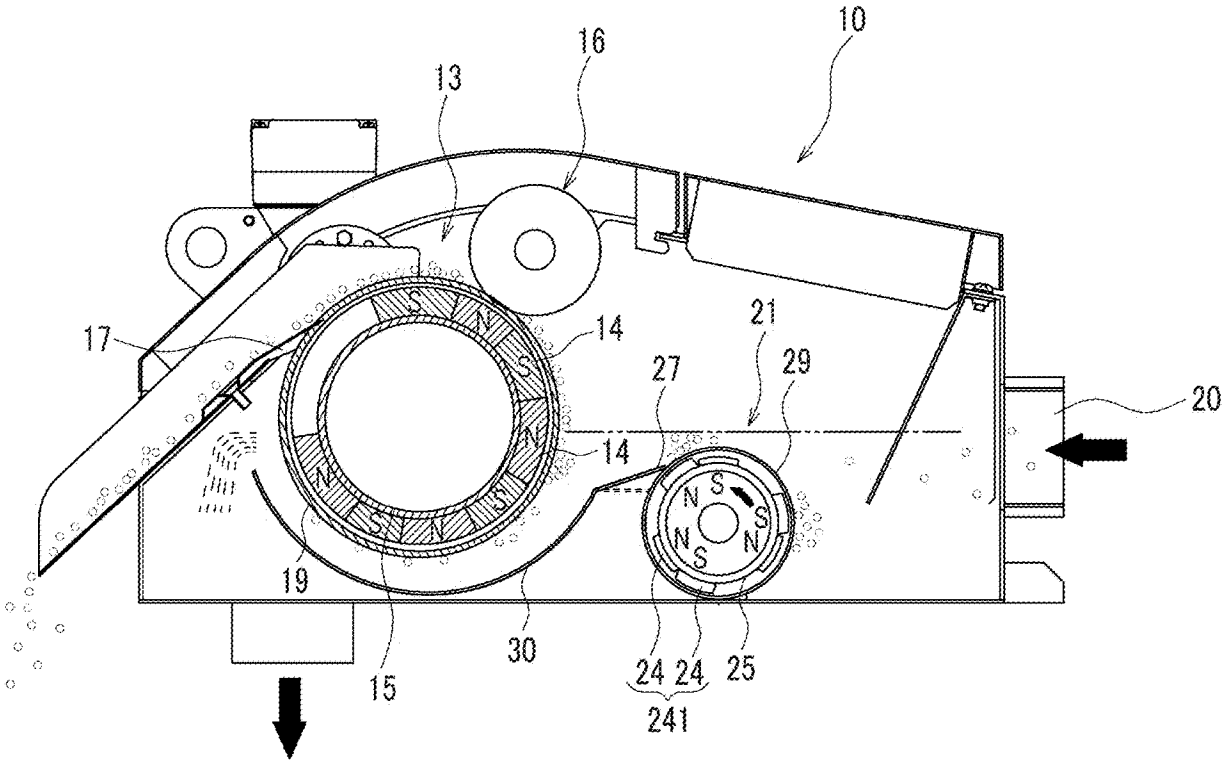
FIG. 7 is a sectional view taken along a surface orthogonal to a rotary shaft of a rotary drum showing another configuration of the rotary drum-type magnetic separator according to the embodiment of the present invention.

FIG. 7 is a sectional view taken along a surface orthogonal to a rotary shaft of a rotary drum showing another configuration of the rotary drum-type magnetic separator according to the embodiment of the present invention. As shown in FIG. 7, in the rotary drum-type magnetic separator according to the present embodiment, the scraper 27 abutting on the outer tube 29 of the second rotary drum 21 is provided to be inclined from the second rotary drum 21 side to the first rotary drum 13 side.

Accordingly, the unnecessary objects attached to the second rotary drum 21 which are scraped off by the scraper 27 easily move with the flow toward the first rotary drum 13 side along the inclination and can be more reliably recovered by the first rotary drum 13.

As described above, according to the present embodiment, the unnecessary objects (magnetic substances) adsorbed by the second rotary drum 21 are attracted to each other by being magnetized, fine particles are collected, and the size per grain increases. Accordingly, since the unnecessary objects become large particles and are introduced to the first rotary drum 13, it is possible to more reliably recover the unnecessary objects by the first rotary drum 13, and it is possible to further improve cleanness of the coolant liquid.

Moreover, various modifications may be applied to the embodiment within a scope which does not depart from the gist of the present invention. For example, a modification of the disposition with respect to the magnets 24 of the second rotary drum 21, a modification with respect to the inclination angle of the scraper 27, or the like may be added.

Moreover, the above-described embodiment discloses the configuration in which the outer tube 29 of the second rotary drum 21 is fixed and the inner tube 25 on which the plurality of magnets 24 are disposed can rotate inside the outer tube 29. However, the present invention is not limited to this. For example, a configuration in which the inner tube 25 on which the plurality of magnets 24 are disposed is fixed and the outer tube 29 can rotate outside the inner tube 25 may be realized, or a configuration in which the inner tube 25 on which the plurality of magnets 24 are disposed and the outer tube 29 can rotate with respect to each other may be realized.

It should be understood that the invention is not limited to the above-described embodiment, but may be modified into various forms on the basis of the spirit of the invention. Additionally, the modifications are included in the scope of the invention.

What is claimed is:

1. A rotary drum-type magnetic separator which separates magnetic substances from a used coolant liquid, comprising:

a first rotary drum on which first rotary drum magnets are disposed;

a second rotary drum on which second rotary drum magnets are disposed; and a scraper configured to scrape off the magnetic substances that are attached to the second rotary drum, wherein the used coolant liquid is flowable along a flow path in a manner that the used coolant liquid flowing in the flow path comes into contact with the second rotary drum before contacting the first rotary drum, the first rotary drum is after the second rotary drum along the flow path.

2. The rotary drum-type magnetic separator according to claim 1, wherein the scraper is inclined to descend toward the first rotary drum side from the second rotary drum side.

3. The rotary drum-type magnetic separator according to claim 1, wherein the second rotary drum includes a strong magnetic portion that has a strong magnetic force and a weak magnetic portion that has a weak magnetic force that is weaker than the strong magnetic force.

4. The rotary drum-type magnetic separator according to claim 1, wherein the second rotary drum magnets include multiple sets of magnets, one of the multiple sets of magnets includes north-polarity magnet that is adjacent to a south-polarity magnet.

5. The rotary drum-type magnetic separator according to claim 4, wherein the south-polarity magnet has a polarity that is opposite to the north-polarity magnet.

6. The rotary drum-type magnetic separator according to claim 4, wherein a thickness of the north-polarity magnet is thicker than a thickness of the south-polarity magnet.

7. The rotary drum-type magnetic separator according to claim 4, wherein the one of the multiple sets of magnets is adjacent to a different the one of the multiple sets of magnets, the different one of the multiple sets of magnets includes a different north-polarity magnet that is adjacent to a different south-polarity magnet.

8. The rotary drum-type magnetic separator according to claim 7, wherein the different south-polarity magnet has a polarity that is opposite to the different north-polarity magnet.

9. The rotary drum-type magnetic separator according to claim 7, wherein the north-polarity magnet and the different north-polarity magnet are of a same polarity.

10. The rotary drum-type magnetic separator according to claim 7, wherein the south-polarity magnet and the different south-polarity magnet are of a same polarity.

11. The rotary drum-type magnetic separator according to claim 7, wherein the north-polarity magnet is adjacent to the different north-polarity magnet.

12. The rotary drum-type magnetic separator according to claim 7, wherein the south-polarity magnet is adjacent to the different south-polarity magnet.

13. The rotary drum-type magnetic separator according to claim 7, wherein along a peripheral surface of the second rotary drum, a distance between the north-polarity magnet and the south-polarity magnet differs from a distance between the north-polarity magnet and the different south-polarity magnet.

14. The rotary drum-type magnetic separator according to claim 1, wherein the second rotary drum includes an outer tube and an inner tube, the second rotary drum magnets are disposed on the inner tube.

15. The rotary drum-type magnetic separator according to claim 14, wherein the outer tube is fixed and the inner tube rotates inside the outer tube.

16. The rotary drum-type magnetic separator according to claim 14, wherein the inner tube is fixed and the outer tube rotates outside the inner tube.

17. The rotary drum-type magnetic separator according to claim 14, wherein the inner tube and the outer tube rotate with respect to each other.

18. The rotary drum-type magnetic separator according to claim 1, further comprising:

a bottom member which forms a flow path below the first rotary drum, wherein the scraper is attached to the bottom member so as to abut to the second rotary drum.

19. A rotary drum-type magnetic separator which separates magnetic substances from a used coolant liquid, comprising:

a first rotary drum on which a plurality of magnets are disposed;

a second rotary drum that is situated before the first rotary drum in a direction in which the used coolant liquid flows such that the magnetic substances are adsorbed to each other; and a scraper configured to scrape off the magnetic substances that are attached to the second rotary drum, wherein the second rotary drum includes a strong magnetic portion that has a magnetic force and a weak magnetic portion that has a magnetic force weaker than the magnetic force of the strong magnetic portion, and wherein the strong magnetic portion and the weak magnetic portion are at equal intervals on a peripheral surface of the second rotary drum.

20. The rotary drum-type magnetic separator according to claim 1, wherein the magnetic substances that are scraped off by the scraper are introduced to the first rotary drum along the flow of the used coolant liquid in a state where sizes of the magnetic substances scraped off by the scraper are increased.

* * * * *